US006672842B1

(12) United States Patent
Lounsberry et al.

(10) Patent No.: US 6,672,842 B1
(45) Date of Patent: Jan. 6, 2004

(54) ROTOCIPROCATING PUMP

(75) Inventors: Peter C. Lounsberry, Endwell, NY (US); Devin W. Brown, Apalachin, NY (US)

(73) Assignee: Applied Technology Manufacturing Corporation, Owego, NY (US)

( * ) Notice: Subject to any disclaimer, the term of this patent is extended or adjusted under 35 U.S.C. 154(b) by 35 days.

(21) Appl. No.: 10/145,694

(22) Filed: May 16, 2002

(51) Int. Cl.[7] ..... F04B 23/08
(52) U.S. Cl. ..... 417/199.2; 184/3.1; 184/29
(58) Field of Search ..... 184/3.1, 3.2, 42, 184/54, 29, 39; 417/199.2, 199.1, 283, 383, 385, 387, 288, 405

(56) References Cited

U.S. PATENT DOCUMENTS

| | | | | |
|---|---|---|---|---|
| 2,428,171 A | | 9/1947 | Mennie | 184/3 |
| 2,512,025 A | * | 9/1950 | Lauck | 103/11 |
| 2,566,707 A | | 9/1951 | Harrigan | 222/254 |
| 2,731,173 A | | 1/1956 | Harrigan | 222/227 |
| 2,881,749 A | | 4/1959 | Pringham | 123/187.5 |
| 3,694,105 A | | 9/1972 | Martin | 417/26 |
| 3,869,224 A | | 3/1975 | Brinkman | 417/383 |
| 4,245,964 A | | 1/1981 | Rannenberg | 417/287 |
| 4,334,596 A | * | 6/1982 | Lounsberry, Jr., | 184/3 A |
| 4,425,986 A | | 1/1984 | Wedlin | 184/3.2 |
| 4,740,140 A | | 4/1988 | Benson | 417/63 |
| 5,076,396 A | * | 12/1991 | Foote | 184/3.1 |

FOREIGN PATENT DOCUMENTS

DE 26 56 553 A1 * 6/1978

* cited by examiner

*Primary Examiner*—Justine R Yu
*Assistant Examiner*—Han L Liu
(74) *Attorney, Agent, or Firm*—Dykema Gossett PLLC

(57) ABSTRACT

A hydraulic pump for use in a pump assembly of a railway track lubricating system includes a housing defining an intake chamber having an intake port, an outlet channel leading to an outlet port, a gear chamber containing interengaged gears, a discharge port having a discharge port, a window opening between the gear chamber and the discharge chamber, and a double head piston having a first head in the intake chamber, a second head in the discharge chamber, and a spring for biasing the piston to a first position where the first head is spaced a maximum from a wall between the intake chamber and the discharge chamber. The outlet port has a smaller cross section than the outlet channel so that checked charged deliveries of hydraulic fluid into the intake chamber will cause the piston to move from its first position to a second position and force grease out of the discharge chamber through the discharge port. The pump assembly includes the rotociprocating pump and a hydraulic motor connected to operate the rotociprocating pump based on flow thereto of hydraulic fluid from the outlet port of the pump.

7 Claims, 5 Drawing Sheets

ORIFICE RESTRICTION
PISTON ADVANCE

CHARGE DELIVERY

PISTON RETURNED, MOTOR
AND PUMP ROTATE

PISTON EXTENDED, MOTOR
AND PUMP START ROTATION

PISTON EXTENDED, MOTOR AND PUMP ROTATE

ORIFICE RESTRICTION, PISTON ADVANCE

ORIFICE RESTRICTION, PISTON ADVANCE

PISTON RETURNED, MOTOR AND PUMP ROTATE

GREASE DELIVERY

ROTOCIPROCATING PUMP

BACKGROUND OF THE INVENTION

1. Field of the Invention

This invention relates to hydraulic pumps and to hydraulic pump assemblies useful in lubricating systems for railway tracks.

2. The Prior Art

Hydraulic pumps are well known devices useful in many different applications. One application where such pumps are useful is in lubricating systems for railway tracks wherein the pump operates to deliver grease from a storage tank to a nearby railway track when an actuator element located adjacent the track is operated by the wheel of a railway vehicle passing thereover. A lubricating system of this type is disclosed in U.S. Pat. No. 4,334,596.

The operational reliability of such hydraulic pumps is of great importance, and investigations into alternative and improved mechanical constructions are an ongoing endeavor.

The present invention is directed to hydraulic pumps which can be used in lubricating systems for railway tracks and which are reliable, simple in construction, and easy to repair, and to lubricating systems using such pumps.

SUMMARY OF THE INVENTION

The inventive hydraulic pump, hereinafter described as a rotociprocating pump, includes a housing which defines an inlet chamber for hydraulic fluid, an inlet port leading to the inlet chamber, an outlet channel extending from the inlet chamber to an outlet port for hydraulic fluid, a gear chamber containing interengaged gears for delivering lubricant such as grease from a storage tank through the gear chamber to a discharge chamber having a discharge port, and a double headed piston which extends from the inlet chamber to the discharge chamber, a first head of the piston being located in the inlet chamber and a second head being located in the discharge chamber. A shaft which extends between the heads extends through a bore in a wall of the housing which separates the inlet chamber from the discharge chamber. A spring is located around the shaft to bias the piston in a first position wherein the first head is spaced a maximum distance from the wall and the second head is located against a opposite side of the wall. In a second position of the piston the first head thereof is located nearer the wall (compressing the spring) and the second head of the piston is located away from the wall and closer to the discharge port.

The outlet port has a smaller cross sectional dimension than that of the inlet channel such that an equivalent volume of hydraulic fluid pulsed through the inlet port into the inlet chamber cannot immediately pass through the outlet channel and out of the outlet port. A one-way check valve is located between the inlet chamber and the outlet channel to prevent back flow of hydraulic fluid from the outlet channel into the inlet chamber. A relief valve is associated with the outlet channel to provide for blow-off of hydraulic fluid in the event of overpressure.

In operation, after the rotociprocating pump has been primed, such that grease has filled the gear chamber and is contained in the discharge chamber, and hydraulic fluid is in the inlet chamber and the outlet channel, a checked pulsed flow of hydraulic fluid into the inlet chamber through the inlet port will result in a flow of hydraulic fluid from the inlet chamber into the outlet channel and in movement of the double headed piston from its first position to its second position, forcing grease out of the discharge chamber and through the discharge port. After the pulsed flow of hydraulic fluid has ceased, the spring will cause the piston to move back to its first position, concurrently causing more hydraulic fluid to flow from the inlet chamber through the outlet channel and out of the outlet port.

A pump assembly for use in a lubricating system includes the rotociprocating pump and a hydraulic motor connected to the gears of the pump, as well as a conduit which connects the outlet port of the pump to a hydraulic motor so that hydraulic fluid flow through the conduit will cause rotation of the gears in the pump. Thus, movement of the double headed piston from its second position to its first position will cause the hydraulic motor to operate and the interengaged gears to rotate and reload the discharge chamber with grease. The grease discharged from the discharge port will be conveyed through a conduit to nearby railway track(s). See U.S. Pat. No. 4,334,596.

The rotociprocating pump of the invention, as well as the pump assembly that includes the rotociprocating pump, is extremely reliable and durable, and requires infrequent servicing.

A better understanding of the invention will be had by reference to the attached drawings taken in conjunction with the following discussion.

DETAILED DESCRIPTION OF THE PREFERRED EMBODIMENTS

Figure 1:
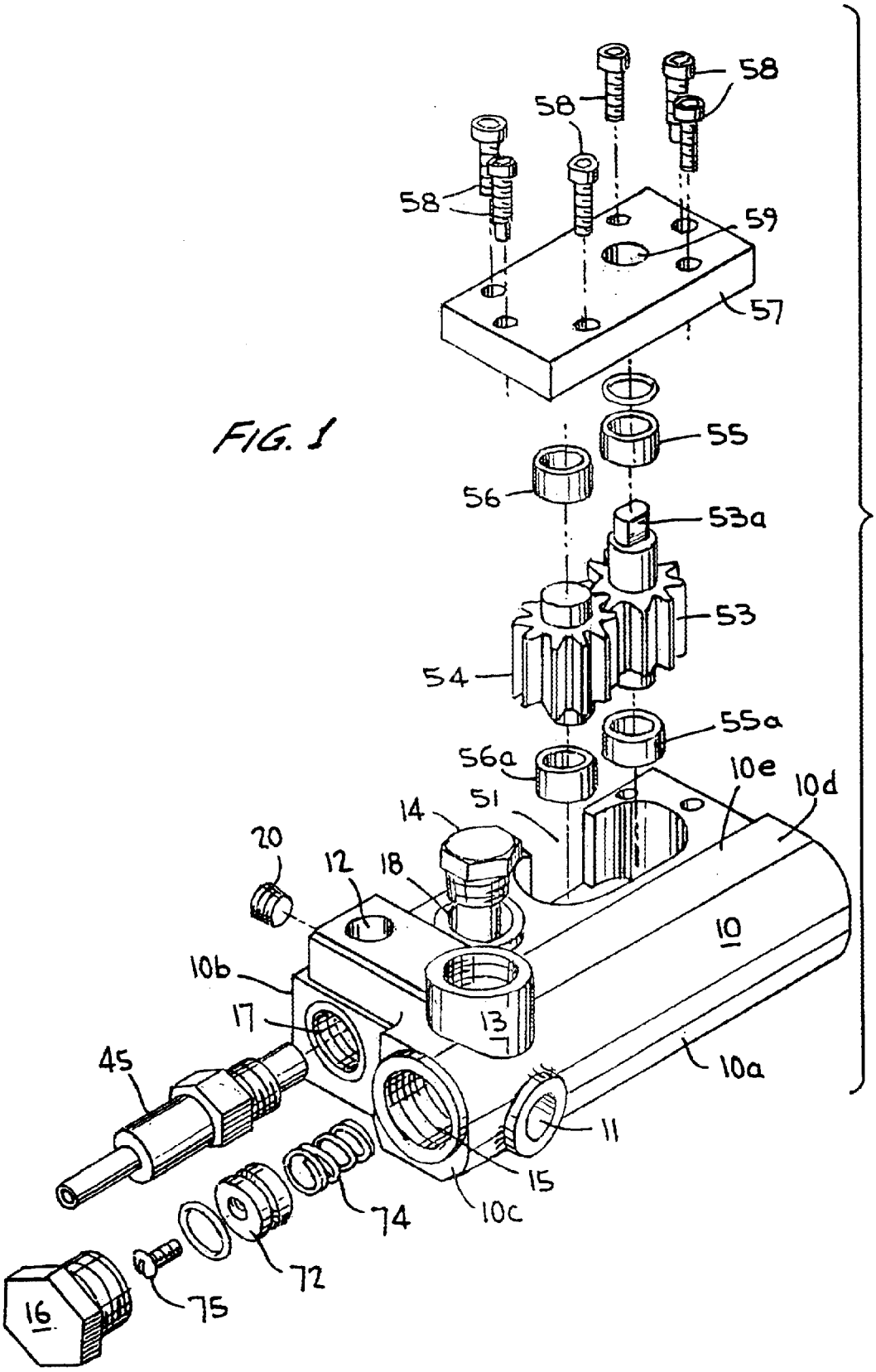
FIG. 1 is an exploded perspective view of a rotociprocating pump according to a preferred embodiment of the present invention.

A preferred embodiment of the rotociprocating pump of the invention is depicted In FIGS. 1–4. It includes an elongated housing 10 having a first side 10*a*, and second side 10*b*, a first end 10*c*, a second end 10*d* and a top 10*e*. The housing defines an inlet chamber 30, an outlet channel 40, a gear chamber 50 and a discharge chamber 60. An internally threaded inlet port 11 in housing side 10*a* enables connection of a conduit (not shown) for delivery of a hydraulic fluid into the inlet chamber 30 and ultimately through the outlet channel to an internally threaded outlet port 12 in the housing top 10*e*. The outlet port 12 has a smaller cross section than that of the outlet channel 40 so as to provide a flow restriction. A boss with an internally threaded opening 13 is provided in the housing top 10*e* above the inlet chamber for seating of a one-way check valve 14. The one-way check valve 14 prevents flow of hydraulic fluid from the outlet channel 40 back into the inlet chamber 30. An internally threaded opening 15 is provided in the housing end 10*c* to provide access to the inlet chamber 30 and enable construction of the piston 70 (discussed below). The opening 15 is closed by a threaded nut 16.

The housing end 10*c* also includes an internally threaded opening 17 for a pressure relief valve 45 which, when installed, is in communication with the outlet channel 40 and which, when activated by overpressure in the outlet channel, will open branch line 41 which leads to relief opening 18 in the housing top 10*e*. A threaded opening 19 in housing side 10*b* enables drilling of the outlet channel 40. The opening 19 is stoppered by a threaded plug 20.

Figure 2:
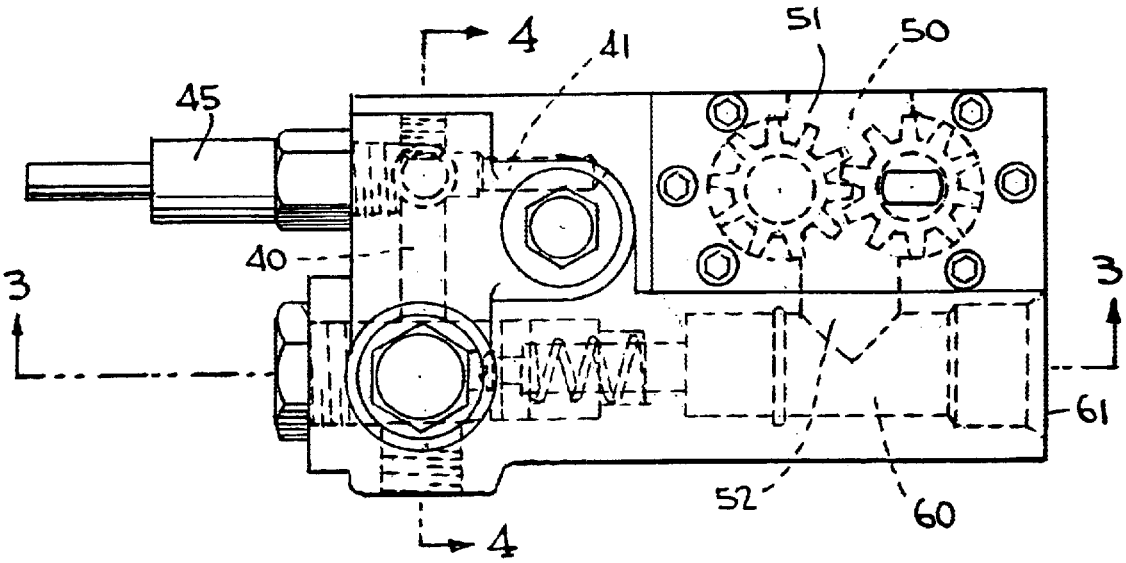
FIG. 2 is a top plan view of the rotociprocating pump of FIG. 1.
Figure 3:
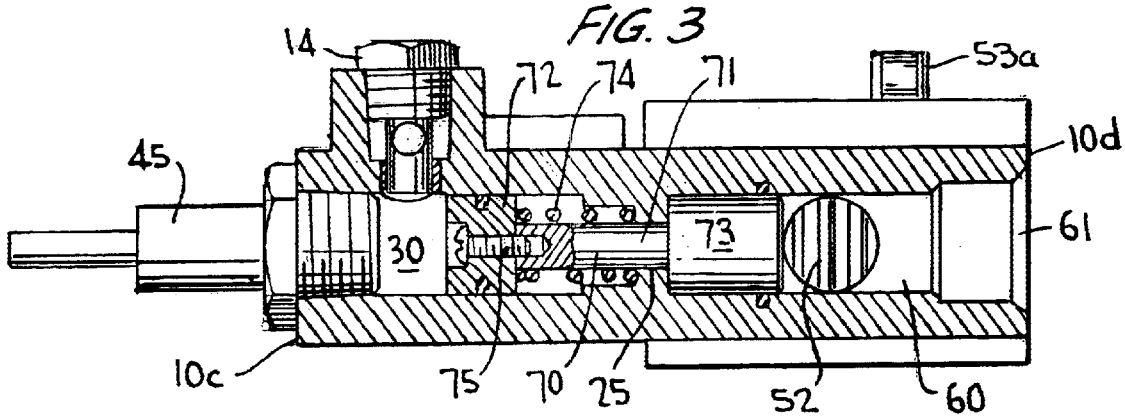
FIG. 3 is a sectional view of the rotociprocating pump as seen along line 3—3 of FIG. 2.
Figure 4:
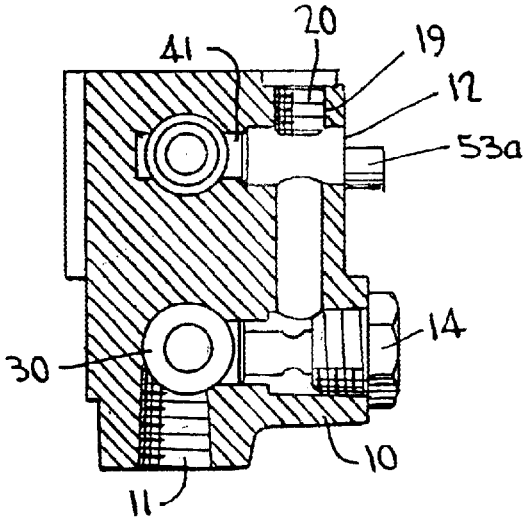
FIG. 4 is a sectional view of the rotociprocating pump as seen along line 4—4 of FIG. 2, and FIGS. 5–13 schematically depict a pump assembly for use in a railway lubricating system according to the invention, the pump assembly including a rotociprocating pump according to FIGS. 1–4 and an interconnected hydraulic motor, these figures showing the sequential steps of priming the pump assembly for use.

An intake opening 51 in the housing side 10*b* communicates with gear chamber 50, which in turn communicates with the discharge chamber 60 via a window opening 52 (see FIGS. 2 and 3). Located in gear chamber 50 are interengaged drive gear 53 and idler gear 54, which are respectively mounted on upper and lower ring bearings 55, 55*a* and 56, 56*a*. A cover plate 57 is positioned over the gear chamber and connected to the housing by bolts 58. An opening 59 in the cover plate enables a contoured end 53*a* of the drive gear 53 to extend outwardly of the housing for connection to an external means for rotation. Rotation of the drive gear 53 and thus idler gear 54 will cause grease to flow through the intake opening 51, through the gear chamber 50, through the window opening 52 and into the discharge chamber 60, Discharge chamber 60 communicates with an internally threaded discharge port 61 in the housing end 10*d*.

As best seen in FIG. 3, the housing provides a bore 25 in a wall which separates inlet chamber 30 from the discharge chamber 60. A double headed piston 70 is positioned to move back and forth through the bore 25. The piston includes a shaft 71 which extends through the bore, a first head 72 which is located in the inlet chamber 30 and a second head 73 which is located in the discharge chamber 60. A spring 74 is located between the first head 72 and the wall so as to bias the first head a maximum distance from the wall and the second head against the opposite side of the wall (first position of the piston). When the piston is in this first position, second head 73 provides no restriction to the window opening 52 (see FIG. 3).

The piston 70 can be initially installed by sliding shaft 71 having the second head 73 is fixedly connected thereto through the discharge port 61 and through discharge chamber 60 until the shaft 71 extends through the bore 25 and into the inlet chamber 30. With the nut 16 removed from opening 15, spring 74 is inserted through opening 15 and slid around the shaft 71, and then first head 72 is connected to the end of shaft 71 by screw 75 (this screw extends into a threaded hole in the end of shaft 71). The nut 16 is then screwed into the hole 15 to seal off the intake chamber.

Figure 5:
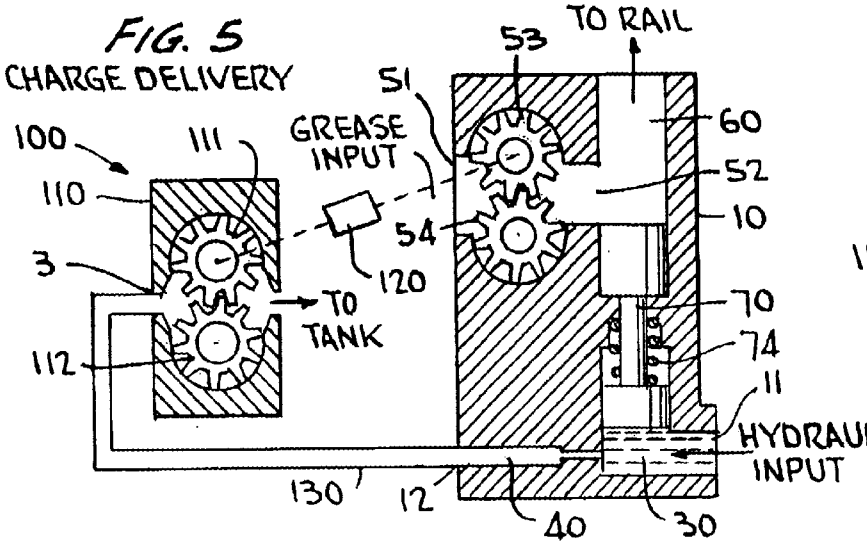

FIG. 5 schematically depicts a pump assembly 100 for a railway lubricating system according to the invention and using the rotociprocating pump of FIGS. 1–4. The assembly includes the pump 10, whose intake opening 51 communicates with a tank of grease (the pump can be immersed in a tank of grease or attached to a wall of such a tank with the intake opening 51 sealed to a suitable opening in a wall of the tank), a hydraulic motor 110 having interengaged gears 111,112, a coupler 120 connecting gear 111 of the hydraulic motor with the drive gear 53 of pump 10, and a conduit 130 which extends from outlet port 12 of pump 10 to an input opening 113 of hydraulic motor 110. The hydraulic fluid passing out of the hydraulic motor will be recirculated by suitable lines (not shown) to the means supplying the hydraulic fluid to the inlet port 11.

Figure 6:
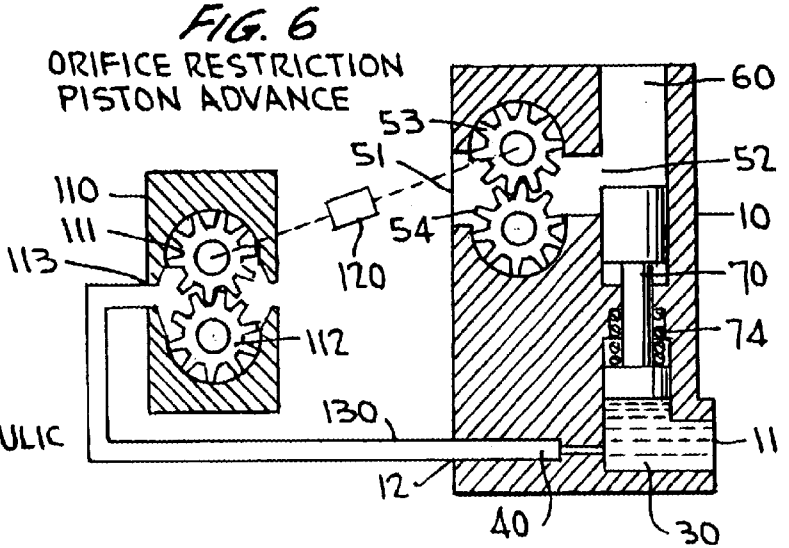
Figure 8:
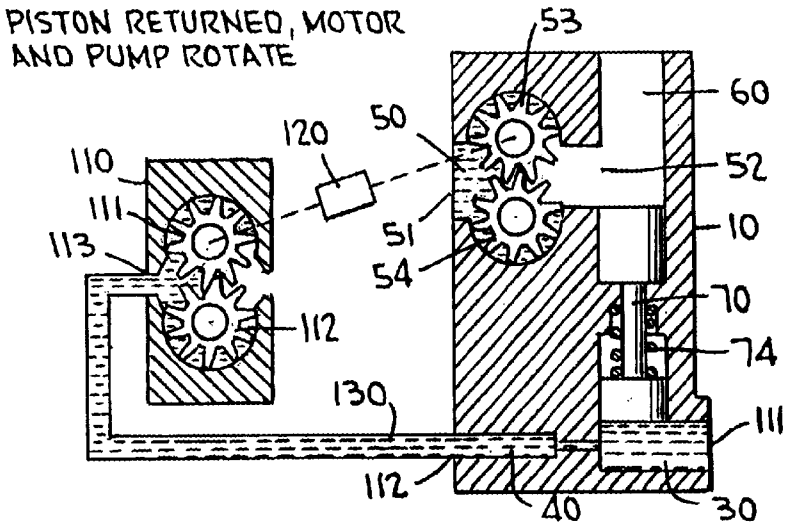
Figure 7:
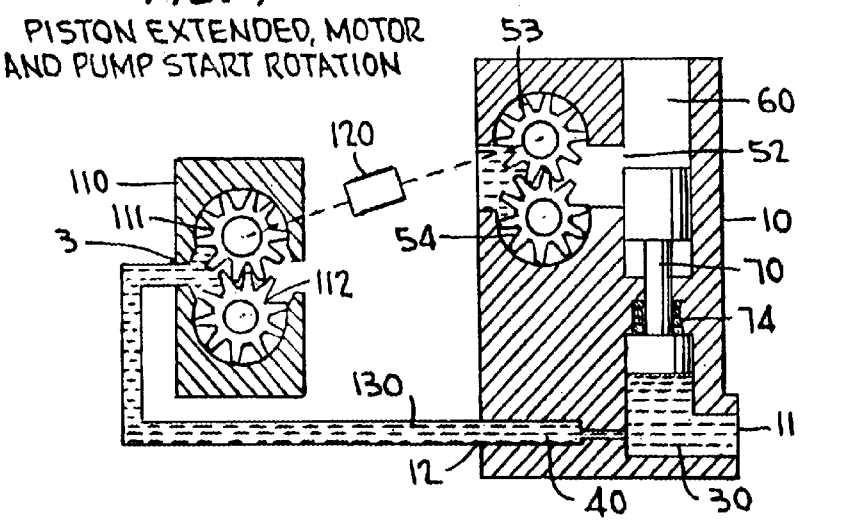
Figure 10:
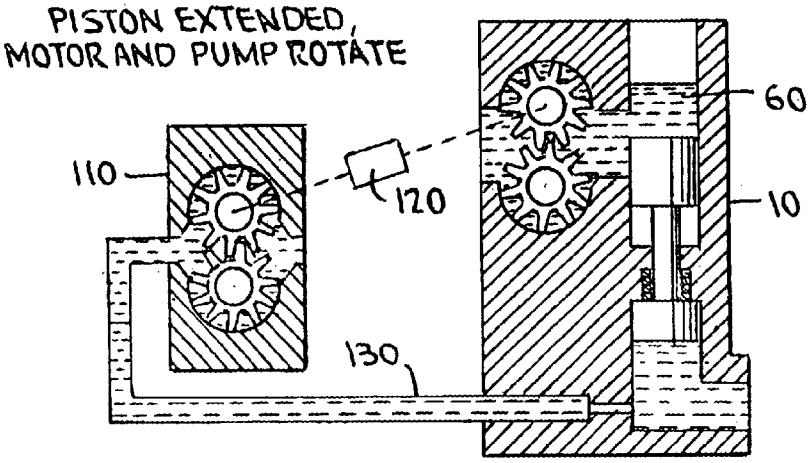
Figure 12:
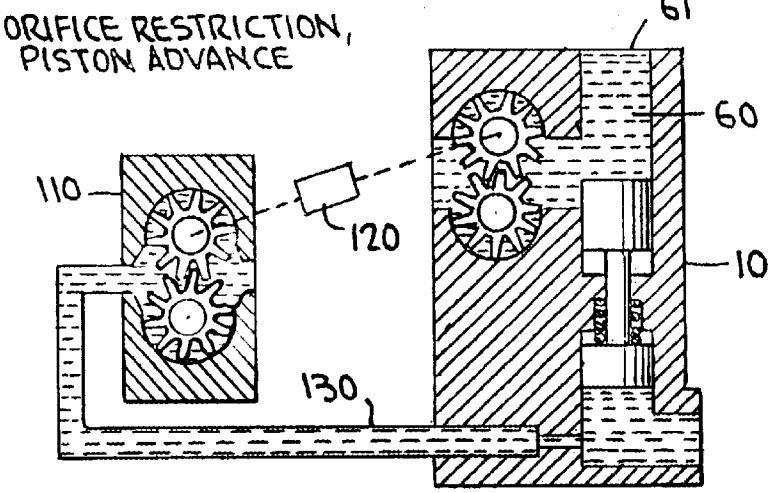
Figure 9:
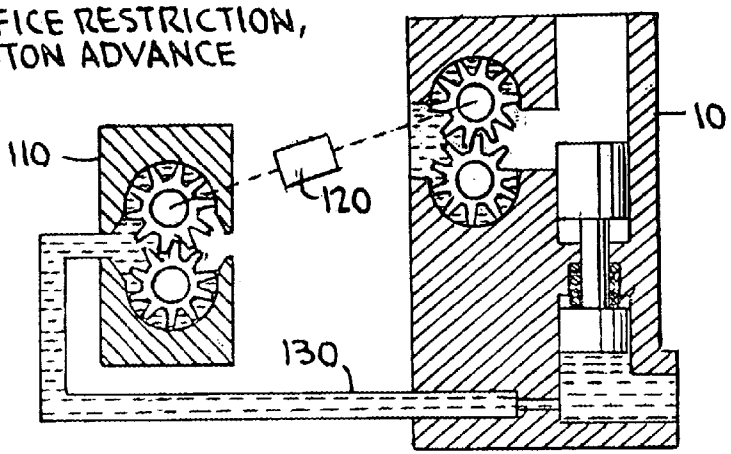
Figure 11:
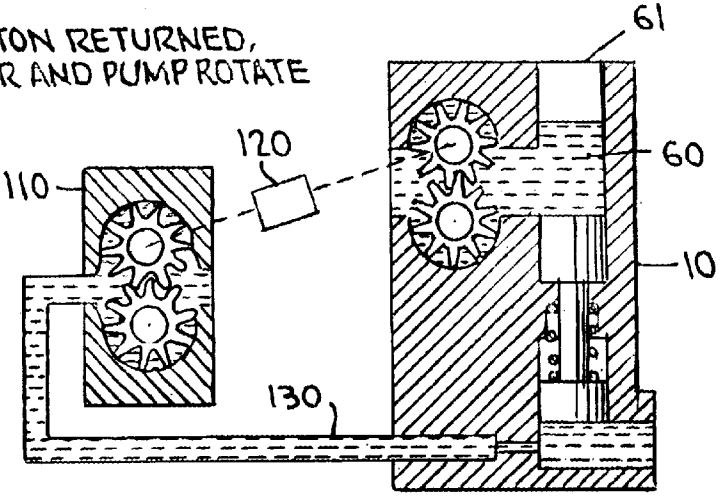
Figure 13:
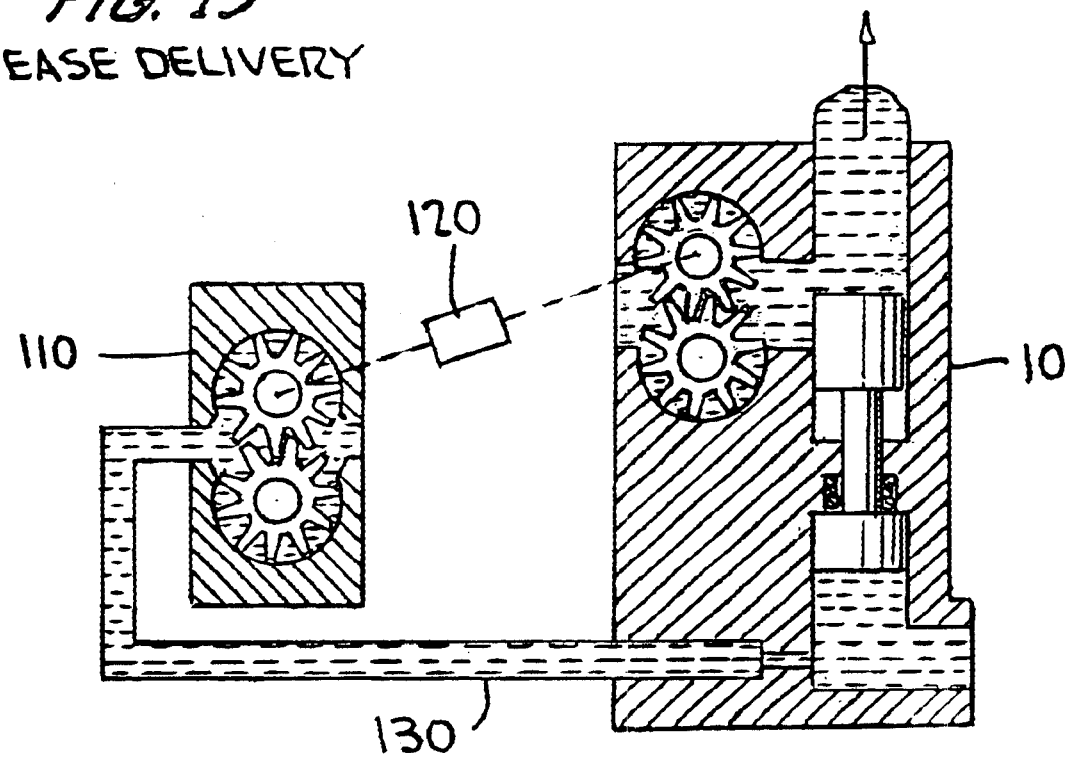

FIGS. 5–13 depict the steps of priming and operating the pump assembly when used in a railway track lubricating system. Charge delivery of hydraulic fluid to intake chamber 30 via inlet port 11 (such as from a checked input line from an actuator element positioned adjacent a railway track as disclosed in U.S. Pat. No. 4,334,596) causes the piston 70 to move from its first position and against spring 74 to its second position and for hydraulic fluid to enter outlet channel 40, conduit 130 and the hydraulic motor 110. Rotation of gears 111,112 in the hydraulic motor 110 will cause gears 53,54 in the pump to rotate and bring grease into the gear chamber from a tank (not shown) through intake opening 51 (FIGS. 5–7). After hydraulic flow into the inlet chamber 30 has ceased, the spring 74 will cause the piston 70 to move back to its first position, causing further hydraulic fluid to flow through the outlet channel 40, the conduit 130 and the hydraulic motor 110, and thereby further rotate gears 111,112. Further rotation of gears 111,112 in the hydraulic motor will cause further rotation of gears 53, 54 in the pump 10, such that more grease will be delivered into gear chamber 50 (FIG. 8). A second charge delivery of hydraulic fluid into the intake chamber 30 (FIG. 9) will eventually cause grease to be delivered into the discharge chamber 60 (FIGS. 10–11). A further charge delivery of hydraulic fluid into the inlet chamber 30 will cause the piston 70 to discharge grease from discharge chamber 60 through discharge port 61 (FIGS. 12–13) and through a delivery line to one or more grease applicators It should be noted that the pump assembly as depicted in FIGS. 5–13 can alternatively be used in other types of delivery systems to continuously supply media in such systems a continuous supply of hydraulic fluid though inlet port 11 to inlet chamber 30 will cause the piston 70 to move to its second position and the continuing input of hydraulic fluid will pass through the outlet channel 40, the outlet port 12 and through the conduit 130 to the hydraulic motor 110, which in turn will continuously rotate the gears 53, 54 of the pump 10 so as to continuously supply whatever media is supplied to the gear chamber 50 through the intake opening 51 to the discharge chamber 60 and out of the discharge port 61 (note that when the piston 70 is in its second position the head 73 thereof blocks only about 60% of the cross section of opening 52).

Although preferred embodiments of the invention have been described in detail, modifications therein can be made an still fall within the scope of the appended claims.

We claim:

1. A rotociprocating pump which comprises a housing defining an inlet chamber; an inlet port leading to the inlet chamber; an outlet port; an outlet channel leading from the inlet chamber to the outlet port, said outlet port having a smaller cross section than a cross section of said outlet channel; a gear chamber; a discharge chamber; an intake opening leading to the gear chamber; a window opening leading from said gear chamber to said discharge chamber; a discharge port communicating with the discharge chamber; interengaged gears positioned in the gear chamber for conveying fluid from the intake opening to the discharge chamber; and a double-headed piston having a first head in the inlet chamber and a second head in the discharge chamber, such that after priming fluid has moved through the gear chamber into the discharge chamber; checked pulses of fluid entering the inlet chamber through the inlet port will move the piston from a first position to a second position so as to discharge fluid from the discharge chamber through the discharge port.

2. A rotociprocating pump as defined in claim 1, including a spring in said inlet chamber for biasing said piston to said first position.

3. A rotociprocating pump as defined in claim 2, including a one-way check value for permitting flow of hydraulic fluid from said inlet chamber to said outlet channel and preventing reverse hydraulic fluid flow from said outlet channel to said inlet chamber.

4. A rotociprocating pump as defined in claim 3, wherein said housing defines a relief opening and a pressure relief line extending from said outlet channel to said relief opening, and including a relief valve in said outlet channel to cause discharge of hydraulic fluid through said pressure relief line and relief opening when over pressurized.

5. A rotociprocating pump according to claim 1, wherein when said piston is in said second position, said second head thereof does not block said window opening.

6. A pump assembly for use in a railway lubricating system which comprises:

a rotociprocating pump which comprises a housing defining an inlet chamber; an inlet port leading to the inlet chamber; an outlet port; an outlet channel leading from the inlet chamber to the outlet port, said outlet port having a smaller cross section than a cross section of said outlet channel; a discharge chamber; a gear chamber in communication with the discharge chamber; an intake opening leading to the gear chamber; a discharge port communicating with the discharge chamber; interengaged gears positioned in the gear chamber for conveying fluid from the inlet opening to the discharge chamber; and a double-headed piston having a first head in the inlet chamber and a second head in the discharge chamber, such that after priming fluid has moved through the gear chamber into the discharge chamber; checked pulses of fluid entering the inlet chamber through the inlet port will move the piston from a first position to a second position so as to discharge fluid from the discharge chamber through the discharge port, a hydraulic motor connected to rotate said interengaged gears of said rotociprocating pump, and, a conduit connecting said outlet port of said rotociprocating pump with said hydraulic motor to convey hydraulic fluid to said hydraulic motor to operate same.

7. A pump assembly according to claim 6, including a coupling means interconnecting gears of said hydraulic motor with said interengaged gears of said rotociprocating pump.

* * * * *